US005975776A

United States Patent [19]

Groenke

[11] Patent Number: 5,975,776

[45] Date of Patent: Nov. 2, 1999

[54] DOT MATRIX PRINT HEAD WITH UNITARY ARMATURE ASSEMBLY AND METHOD OF OPERATION THEREOF

[75] Inventor: Jeffery Groenke, Escondido, Calif.

[73] Assignee: Axiohm Transaction Solutions, Inc., Bluebell, Pa.

[21] Appl. No.: 08/870,757

[22] Filed: Jun. 9, 1997

Related U.S. Application Data

[63] Continuation-in-part of application No. 08/468,643, Jun. 6, 1995, abandoned.

[51] Int. Cl.[6] ..... B41J 2/27

[52] U.S. Cl. ..... 400/124.21; 400/124.23; 400/124.28

[58] Field of Search ..... 400/124.01, 124.18, 400/124.11, 124.14, 124.17, 124.21, 124.23, 124.24, 124.28

[56] References Cited

U.S. PATENT DOCUMENTS

| | | | |
|---|---|---|---|
| 3,672,482 | 6/1972 | Brumbaugh et al. . | |
| 4,222,674 | 9/1980 | Mori et al. . | |
| 4,459,051 | 7/1984 | Kawai . | |
| 4,493,568 | 1/1985 | Estabrooks . | |
| 4,755,068 | 7/1988 | Hebert | 400/124.18 |
| 4,778,292 | 10/1988 | Kikuchi et al. . | |
| 4,792,247 | 12/1988 | Sakaida et al. . | |
| 4,802,781 | 2/1989 | Sheerer . | |
| 4,812,061 | 3/1989 | Tsuyuki . | |
| 4,818,129 | 4/1989 | Tanuma et al. . | |
| 4,884,905 | 12/1989 | Smith . | |
| 4,993,855 | 2/1991 | Adamek et al. . | |
| 5,033,885 | 7/1991 | Gugel et al. | 400/124.18 |
| 5,482,387 | 1/1996 | Tanuma et al. . | |

FOREIGN PATENT DOCUMENTS

| | | |
|---|---|---|
| 0474254 | 3/1992 | European Pat. Off. . |
| 56-4470 | 1/1981 | Japan . |
| 57-173178 | 10/1982 | Japan . |
| 58-90965 | 5/1983 | Japan . |
| 1249459 | 4/1989 | Japan . |
| 39861 | 1/1991 | Japan . |
| 324968 | 2/1991 | Japan . |

OTHER PUBLICATIONS

IBM Technical Disclosure Bulletin, vol. 31, No. 3, Aug., 1988.

*Primary Examiner*—John Hilten
*Attorney, Agent, or Firm*—Brown Martin Haller & McClain LLP

[57] ABSTRACT

A print head is disclosed which includes a unitary armature assembly including a thin resilient spring, thick structural members and cores upon which a magnetic flux path can be electrically imposed, such that motion of the armatures is constrained to only the desirable back-and-forth axial movement of an ideal print stroke. Lateral movement of the armatures is prevented, so that armatures wires wear only very slowly, resulting in long and reliable service life. Improved performance for size is obtained by having the magnet plate positioned with the working air gap on the outside and the return pole on the inside, with the armature pivot at the outside periphery of the print head, so that the larger magnet area imparts greater magnetic force, an increased length of the lever arm for the print wire, and enhancement of the print stroke and the printing performance of the device. The wire guide pattern provides bidirectional and orthogonal printing capability. Heat transfer is obtained through a heat sink. A universal connection bracket is provided for connection to numerous printers.

26 Claims, 4 Drawing Sheets

DOT MATRIX PRINT HEAD WITH UNITARY ARMATURE ASSEMBLY AND METHOD OF OPERATION THEREOF

CROSS-REFERENCE TO RELATED APPLICATION

This application is a continuation-in-part of application Ser. No. 08/468,643, filed Jun. 6, 1995, and entitled "DOT MATRIX PRINT HEAD WITH BIDIRECTIONAL CAPABILITY", now abandoned.

BACKGROUND OF THE INVENTION

1. Field of the Invention

The invention herein relates to dot matrix printers and print heads. More particularly it relates to the structure of such print heads and their method of operation.

2. Description of the Prior Art

Dot matrix printers are widely used for transaction receipts and convenience printing. These applications include cash registers, automatic teller machines, gas pumps, lottery tickets, credit card verification, bar code printing, etc. The dot matrix printer, like other impact printers, can produce multiple carbon (or carbonless) copies. It is important for the print head, to be durable, to operate at high speed, to be as simple as possible in construction and to be highly reliable.

Impact print heads operate by forcing the tip of one or more of a plurality of elongated pins against an inked ribbon which is adjacent to the paper or other substrate on which the printed characters are to be formed. The impact of each pin tip drives the ribbon against the paper and leaves an inked dot in the location of that pin. By controlling the number and location of the pins which are activated, and by moving the pin array and paper relative to each other between successive activations of the pins, a collection of such dots is produced which appears as a number, letter, other character, or as a picture, figure or design.

When the print head is in operation, electromagnetic actuators provide force to armatures which act on the driving end of the pins causing them to be reciprocated rapidly to create lines of text, drawings, etc. Ideally the armatures should move only in the back-and-forth direction of print activation. However, in many prior art print heads, armatures also experience substantial lateral motion within their travel channels, which causes substantial wear on the armatures and their mating surfaces at the pivot point, reducing print head life. Commonly print head life has been no more than 100 million characters prior to needing replacement. For high speed dot matrix printers which are used heavily, this translates into relatively frequent replacement of print heads, which is of course uneconomical for the printer user.

To make the most efficient use of high speed dot matrix printers, many users run multi-sheet documents through them, so that with one pass the printer will make multiple copies of each document. In order to maximize the number of layers of paper (i.e., numbers of copies) which can be legibly printed, the pins must be driven firmly against the ribbon and document. In many prior art printers the performance of the print head is not sufficient to produce the number of legible copies per pass that the user wants, and so additional sets of the same document must be run in order to produce the desired total number of copies. If the performance of the print head could be improved, the number of repetitions of a document could be reduced for creation of the same number of copies.

In order to achieve sufficient striking force against the print ribbon to form a clean character on multiple layers of paper, the print wire must be relatively stiff. Since the driving magnets for the print wires are usually arranged in a circle, the print wire must be bent to achieve a vertical column at the output guide. The greater the curvature of the print wire, also related to pullback, the more friction, the more wear and the more driving force is needed. It is the goal of the head design to minimize pullback, lower friction and to reduce wear.

Numerous attempts have been made to alleviate the friction and pullback problems. In most cases, the print wire guides are designed to ease the movement of the print wires through their curves. Such devices have been modestly successful, but problems of friction and wear remain significant.

Most of the print heads with the magnetic gap at the outside pole have armature pivots at the inside pole of the magnetic yoke. While this provides the maximum room for the coils, it limits the lever ratio of the armature which reduces the stroke of the print wire. Using the pivot point at the inside pole also has two other limitations: (1) the print wire length is much shorter than the length of the head, and (2)when the pivot point wears it reduces the stroke of the print wire. The shorter print wire increases the curvature, the stress and the wear between the wire and the guides. An alternate design has the armatures pivoted at the outside pole, then the coils and the active gap are located at the inside pole. In this case, the coils are crowded and the cooling of the coils are less efficient.

Many prior art printers are capable only of printing in the forward direction (i.e., left to right across the paper). This requires the carriage to return to the start of a each line, and the return time is simply lost time from the printing process. Some prior art printers have improved print speed by being capable of linear bidirectional printing: both forward (left to right) and backward (right to left), so that there is no lost carriage return time. A printer that simply prints back and forth requires special logic to reverse the character string and the font, but it requires nothing special from the print head. However, most prior art printers do not have the capability of orthogonal bidirectional printing, i.e., the capability to have the head to move in horizontal and vertical (orthogonal) directions. The orthogonal motion of the print head requires a special output pattern of the print wire to be designed into the print head.

SUMMARY OF THE INVENTION

The print head of the present invention overcomes these various problems. Through the inclusion of the novel unitary armature assembly including a thin resilient spring, thick structural members and cores upon which a magnetic flux path can be electrically imposed, the motion of the armatures is constrained to only the desirable back-and-forth axial movement of an ideal print stroke. Lateral movement of the armatures is prevented, so that the pivot point of the armatures and their mating surfaces wear at a much slower rate than has been the case for prior art printers. Since wear of the moving parts is a primary cause of print head failure, reliability of the print heads of the present invention is markedly improved over that of the prior art print heads. Rather than having a maximum of 200 million print strokes, devices of the present invention have performed continuously and reliably for over 500 million print strokes.

Further, the structure of the present print heads provides for improved performance for the size. With the magnet plate positioned such that the working air gap is on the outside and the return pole is on the inside, with the armature pivot at the outside periphery of the print head, the larger magnet area imparts greater magnetic force and there is an increased length of the lever arm for the print wire, which enhances the print stroke and therefore also the printing performance of the device.

Bidirectional, and particularly orthogonal, printing capability is provided by a novel output guide pattern. In particular, the alignment of the print wire ends is such that the print head can print continuously while either it or the print receiving medium is traversing in two orthogonal directions.

The structure also permits the coils to be positioned where there is ample room while enhancing the mechanics, the heat transfer and the stroke of the print wire. Heat sink mounting is readily accomplished with excellent heat transfer from the coils.

The head can be connected to a variety of different printers through a universal attachment structure which requires merely changing of just the printed circuit board and a snap-in ribbon guide. The ribbon guide and the printed circuit board (or an equivalent flexible printed circuit) may be customized and changed with minimum impact to the head assembly.

In one broad embodiment the invention is a dot matrix print head for printing on a print receiving medium, the print head comprising a plurality of elongated print wires, each print wire having a printing end and a driving end; a wire housing comprising a guide nose for aligning the printing ends of the print wires into a predetermined alignment and guiding the print wires in the alignment during a printing stroke; reversible actuating means for selectively actuating the print wires for the printing stroke through the driving ends, the actuating means comprising an armature assembly, the armature assembly comprising a plurality of print wire contacting fingers equal in number to the number of print wires and a magnetically soft plunger on each finger, each finger being cantilevered and having its fulcrum in the outer perimeter area of the armature; a magnetic yoke adjacent to the fingers of the armature assembly and having a plurality of activatable electric coils mounted on poles thereon and a flux plate operably associated therewith, each coil in proximity to a respective plunger, such that application of electric current to a coil creates a magnetic field in the yoke, pole and flux plate adjacent to the plunger urging the plunger toward the pole and coil and causing deflection in the finger, the deflection contacting the driving end of a print wire and activating the print wire into a printing stroke; a resilient member incorporated in the armature assembly for biasing the armature fingers away from the print wires when electrical current is not applied to the coils; and biasing members each cooperating with a print wire for returning the print wires to their initial positions following the printing stroke when the armature fingers are biased away from the print wires, such print wires thereupon being positioned for a subsequent printing stroke.

In another broad embodiment the invention is a method for imparting print to a print receiving medium, the method comprising providing a print head comprising a plurality of elongated print wires, each print wire having a printing end and a driving end; a wire housing comprising a guide nose for aligning the printing ends of the print wires into a predetermined alignment and guiding the print wires in the alignment during a printing stroke; reversible actuating means for selectively actuating the print wires for the printing stroke through the driving ends, the actuating means comprising an armature assembly, the armature assembly comprising a plurality of print wire contacting fingers equal in number to the number of print wires and a magnetically soft plunger on each finger, each finger being cantilevered and having its fulcrum in the outer perimeter area of the armature; a magnetic yoke adjacent to the fingers of the armature and having a plurality of activatable electric coils mounted on poles thereon and a flux plate operably associated therewith, each coil in proximity to a respective plunger, such that application of electric current to a coil creates a magnetic field in the yoke, pole and fluxplate adjacent to the plunger urging the plunger toward the pole and coil and causing deflection in the finger, the deflection contacting the driving end of a print wire and activating the print wire into a printing stroke; a resilient member incorporated in the armature assembly for biasing the armature fingers away from the print wires when electrical current is not applied to the coils; and biasing members each cooperating with a print wire for returning the print wires to their initial positions following the printing stroke when the armature fingers are biased away from the print wires; applying an electric current toat least one of the coils thereby actuating the print wire associated with each actuated coil into a printing stroke and causes a visible dot to be imprinted on the print receiving medium; and thereafter halting application of the electric current such that each coil is deactuated and the resilient means and the biasing means cause each print wire to return to its initial position.

The print head of this invention may be used for printing on a wide variety of print receiving media, including paper, cloth, cardboard, metal and wood, depending on the nature of the ink impregnated into the ribbon on the specific printer into which the print head is mounted. The print head will find use in many business, industry and home applications, including computer generated printing, such as word processing, desktop publishing, graphics and industrial design and CAD applications; point of sale transaction recording, invoicing and receipting; bar code labeling; and the like.

DETAILED DESCRIPTION AND PREFERRED EMBODIMENTS

Figure 1:
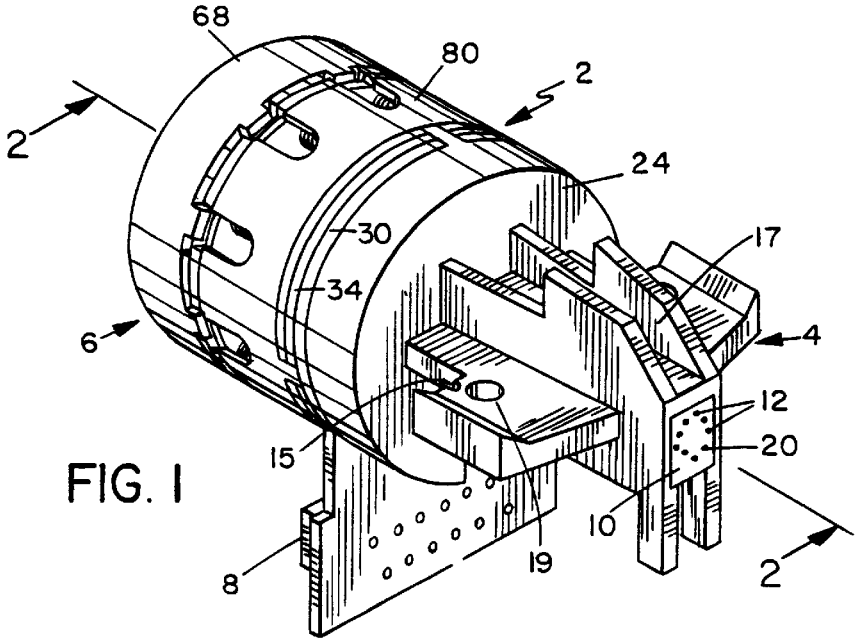
FIG. 1 is a perspective view of the print head of this invention, viewed from the printing end.

The invention is best understood by reference to the drawings. FIG. 1 shows the print head 2 which is composed of a wire housing or nose portion 4 and a drive portion 6. An electrical power cable provides power to the individual driving magnet for each print wire through connector 8 to a circuit board which can be rigid or flexible. The output guide 10 holds the printing ends 12 of the print wires in the critical alignment of this invention.

Figure 2:
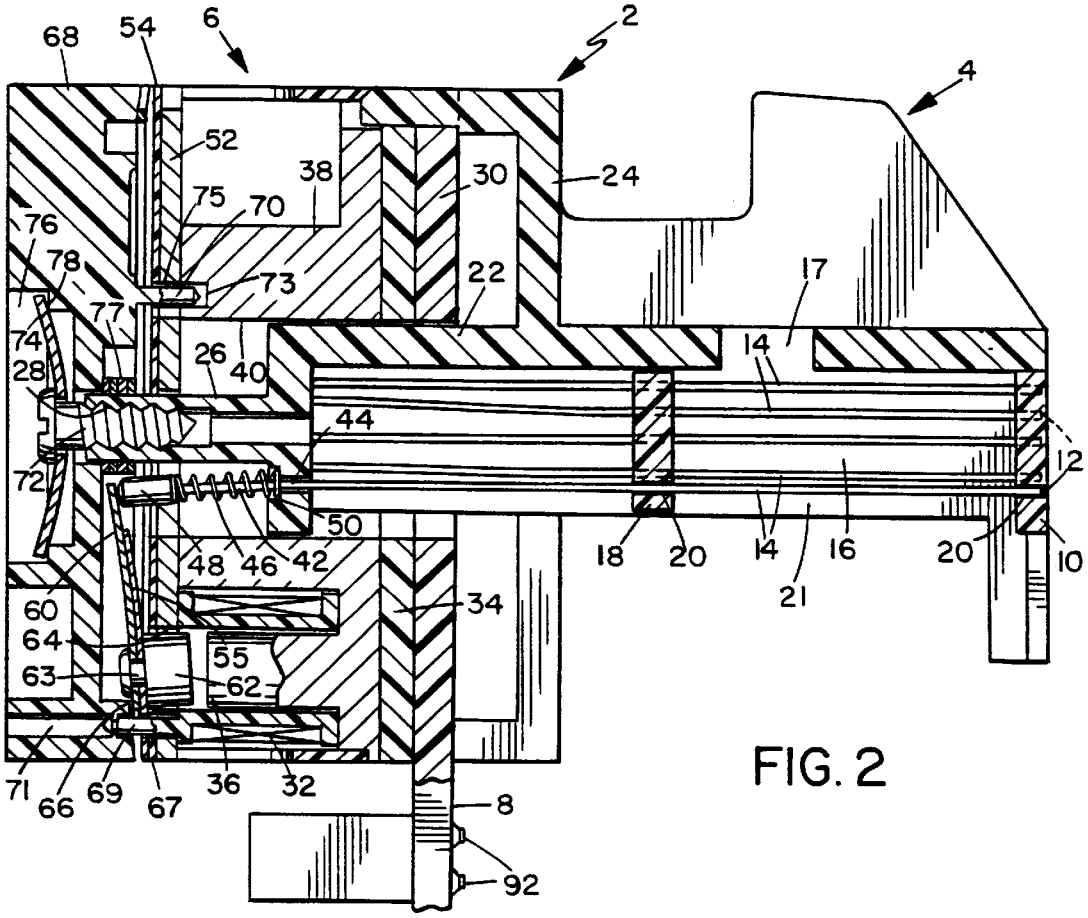
FIG. 2 is an enlarged cross-sectional view taken on line 2—2 of FIG. 1.
Figure 3:
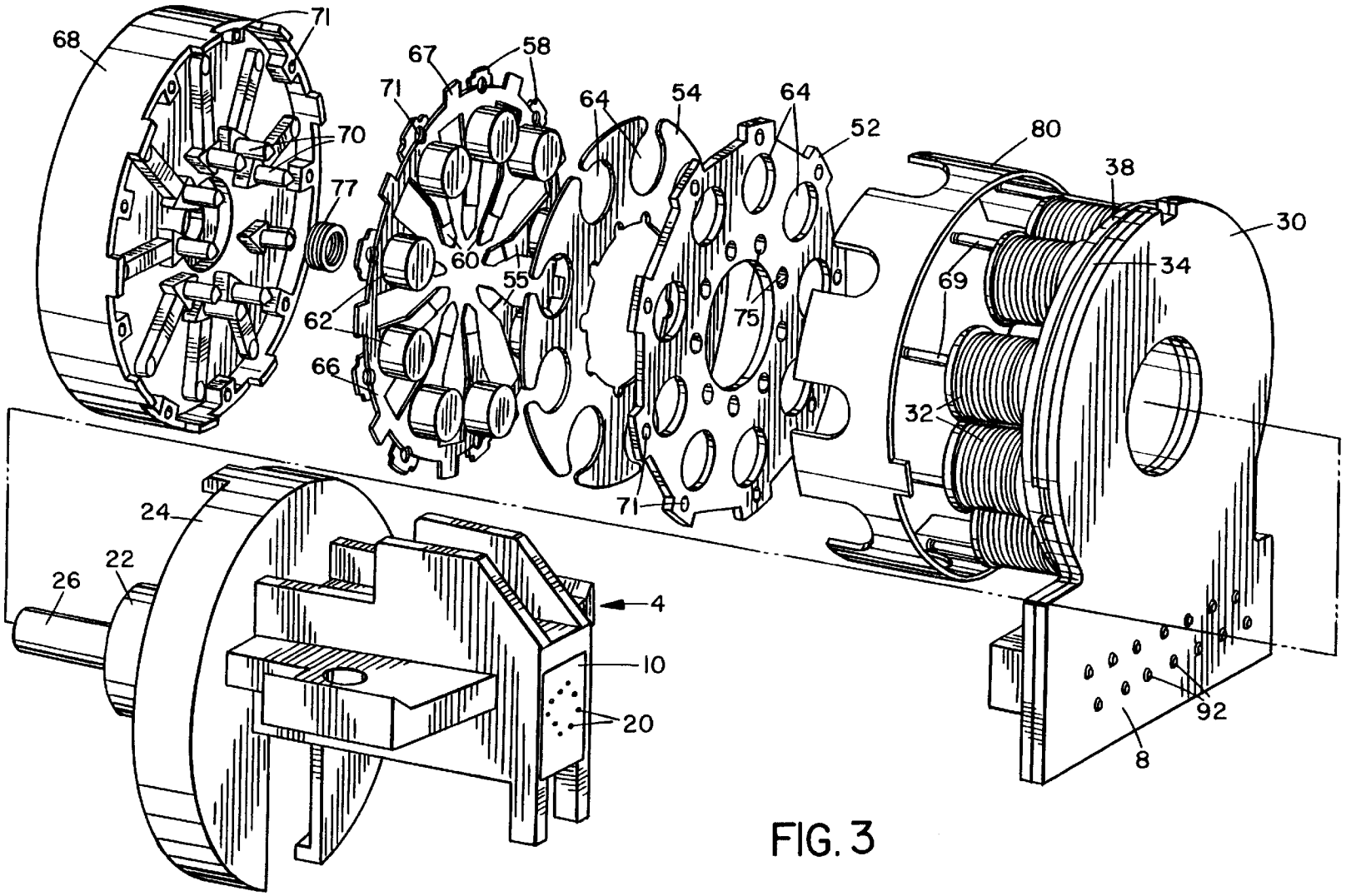
FIG. 3 is an exploded view of a number of components of the head.

FIG. 2 illustrates in detail the structure of the print head 2 as assembled. There are a plurality of N pins or print wires 14 (typically N is 7, 9, 18 or 24) which by their impact on an inked print ribbon (not shown) causes the ribbon to be forced against a sheet of paper or another print receiving medium (also not shown) creating 1 to N inked dots per activation, depending on how many of the N print wires are activated simultaneously. Traversing movement of the print head 2 with respect to the medium in conjunction with rapidly repeated and selective activations of the print wires 14 and impact with the medium causes multiple arrays of dots to be formed, and the closely spaced vertically arrays form a row of characters (including alphanumeric characters, lines and symbols) printed on the medium. Normally the print head moves to traverse across the medium to print a line, but in many applications the medium may be moved to traverse past a stationary print head. In either case, at the end of one traverse the medium is indexed to align a fresh portion of its surface with the print head and one or the other is traversed to print a second row of characters, and so forth.

Within the housing or nose 4 is an open channel 16 in which the print wires 14 move. Their alignment within the channel 16 is controlled by one or more guides 18 and the output guide 10. Each print wire guide 18 or output guide 10 has a plurality of N holes 20 through which the print wires 14 pass. The alignment of the holes 20 in each successive print wire guide 18 is such that the print wires 14 are curved from their original circular array to the final printing alignment determined by the hole 20 pattern in the output guide 10. The holes 20 may be in any convenient alignment, such as a vertical line, two or more parallel vertical lines, a circle, an X shape or a diamond shape. Illustrated in FIG. 1, and detailed further in FIGS. 4 and 5 and the accompanying text, is an array unique to this invention, which permits the print head to do orthogonal as well as mono- and bidirectional printing.

The housing 4 also is also configured with slots 15 and through holes 19 to enable the print head to be mounted on a variety of different commercial printers. This configuration is designed to interlock with the various kinds of coupling structures used on the principal common printers.

Figure 8:
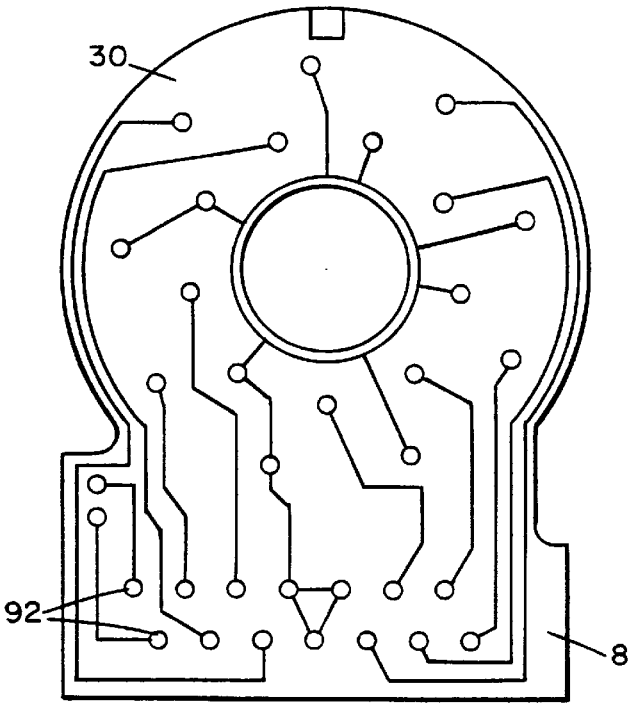
FIG. 8 is a typical circuit board used to distribute power to each magnet coil to activate the individual print wires.

The housing 4 extends out into a hollow circular base 24 and the channel 16 extends to a protruding end 22. A further, smaller protrusion 26 has internal threads 28 and is used to retain the components of the head in the assembly. The base 24 is pressed against a printed circuit board 30 to which a flex-cable (not shown) is attached through connector 8. The circuitry of printed circuit board 30 is such as to connect each magnet coil 32 individually to the an external timing or sequencing device, such as a microcomputer or microprocessor (not shown). A typical circuit board is shown in FIG. 8. Insulating spacer 34 insures that only the desired magnetic coils 32 receive current flow at a given activation. Each of the magnet coils or bobbins 32 is mounted on an iron pole 36 which is part of a circular magnet plate 38 which has a central hole 40 to accommodate the end portion 22 of housing 4, and which keeps the magnet plate 38 and housing 4 in alignment.

The magnet plate 38 forms the yoke for the magnetic flux path when a bobbin coil 32 is activated by application of an electrical current and is, unlike many of the yokes of the prior art, formed with its principal mass on the inside surrounding the centerline. This causes the magnetic flux lines to circle on the inner portion of the device, through the yoke 38, flux plate 75, plunger 62 and pole 36, when an electric current is applied to the coil of the bobbin 32. Because of this "interior" flux pattern, and with the pivot point 66 of the armature fingers 60 placed at the exterior of the device, a long stroke of each finger 60 is obtained. The print wires 14 are long in relation to the length of the overall print head 2 because the magnet plate 38 is in front of the armature 58. This long print wire path has more gentle curvature and less stress. With the coils 32 mounted on the outwardly disposed poles 36, there is more space for the coils and they are more quickly and readily cooled. The use of the shim 54 prevents the plungers 62 from actually impacting the top of the poles 36, so that neither the plungers 62 nor the poles 36 suffer wear which would otherwise shorten the life of the head. Shim 54 also prevents the armature fingers 60 from wearing against the flux plate 75.

The driven or proximal ends 42 of the print wires 14 pass though holes 44 in the end 22 of the nose 4. Each end 42 of a print wire 14 is surrounded by a compression coil spring 46 and is potted in a solid plastic button 48. Spring 46 is seated between the button and a recess 50 in the end 22 of housing 4.

Figure 9:
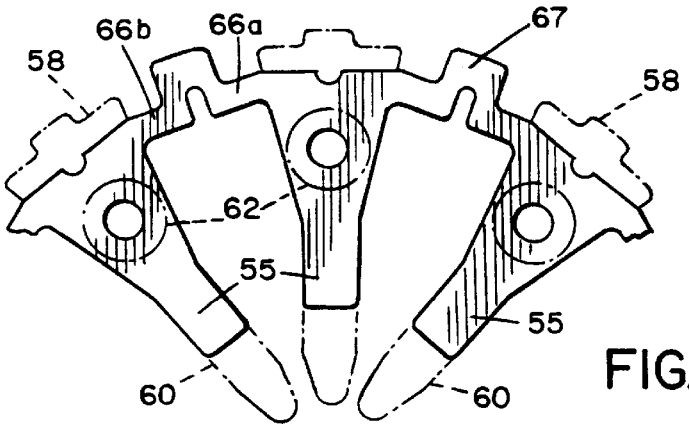
FIG. 9 is a plan view of a portion of the return leaf spring integrated with the armature.

The armature 58 is formed of a circular armature spring 67 to which are attached individual armature fingers 60, the tips 61 of which in turn contact the print wire buttons 48. The armature spring 67 and the armature fingers 60 may be welded together or joined by an adhesive, but preferably are joined by riveting of the plungers to the armature assembly 58 as illustrated at 63. The armature spring 67 is biased away from the magnet plate 38 and therefore cooperates with the compression spring 46 to 11 enhance the return of print wires 14 after impact. A portion of armature spring 67 is illustrated in FIG. 9. The shape of this spring, which has fingers 55 generally conforming to the armature fingers 60, is unique and critical. The one-piece armature spring 67 is designed to provide the appropriate stiffness and strength to return all of the fingers 60 when application of electrical current is halted to the coils 32.

Seated on top of the bobbins 32 is a flux plate 52 and a non-conductive (preferably plastic/rubber) shim 54. Following is the armature assembly 58, to which is attached the magnetically soft plungers 62. The flux plate 52 and the shim 54 have holes 64 to accommodate the plungers 62 and allow each plunger to get very close to its respective magnetic pole 36. In operation the application of a current across the windings of a coil 32 induces magnetic flux at the pole 36 which attracts the plunger 62. As the plunger 62 moves toward the pole 36, it causes the tip 61 of finger 60 to pivot at 66 and push the print wire 14 at the button 48. A prior art ballistic print head usually pivots the armature at the outside pole. Unlike the prior art devices, this armature 58 pivots on the spring at locations **66*a* and 66*b***.

The armature spring 67 is chosen for the proper stiffness and long life. The armature fingers 60 are chosen to be non-magnetic and have the proper rigidity, weight and cost. The plunger 62 is required to be magnetic soft and have a very high magnetic permeability. The fingers 60 are preferably made of stainless steel, which is non-magnetic, and therefore will not magnetically influence each other at the tip where the fingers push the print wires. Further, because the spring 67 and the fingers 60 are assembled from separate parts, there is a wide selection of materials and thickness. All this flexibilty allows the optimum design for long life of the spring as well as optimum mass and strength of the armature. The mass of the armature is reduced because the poles 36 extend nearly to the top of the bobbins 32 to allow shorter plungers. Generally the pole:plunger length ratio will be on the order of approximately 3–4:1. A shorter plunger has two advantages: (1) less mass means higher speed, and (2) there is less radial movement of the plunger as the magnetic gap is opened and closed.

Figure 10:
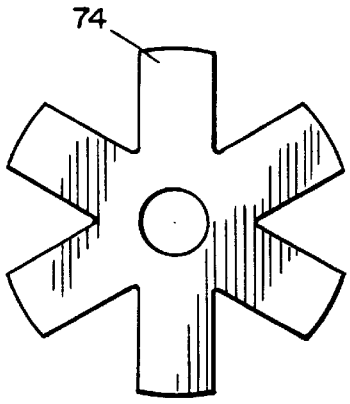
FIG. 10 is a plan view of the leaf spring used to secure the components in assembled configuration.
Figure 11:
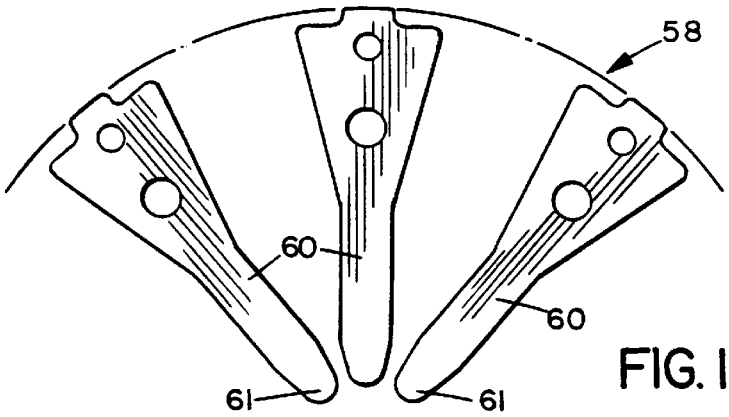
FIG. 11 is a plan view showing alignment of three adjacent fingers of the armature.

The head assembly is secured together by retainer 68, screw 72 and star spring 74. Spring 74 is seated in hole 76 in retainer 68 in contact with annular shoulder 78. Screw 72 is threaded into threads 28 in protrusion 22 to lock the components together. One or more shock absorbing dampers 77 are used as needed for proper settling of the print wires 14 after rebound from impact. All of the components are kept in alignment by bobbin pins 69, which pass through alignment holes 71, and retainer pins 70, which pass through holes 75. The use of star spring 74, which is illustrated in FIG. 10, regulates the contact of the retainer and the flux plate and allows the component tolerances to be less critical. This controls the tolerances and simplifies the assembly. The assembly is also insensitive to the thickness of the printed circuit board 30 or even to the substitution of a flexible printed circuit. This feature allows interchanging components with minimum impact to the head.

Figure 6:
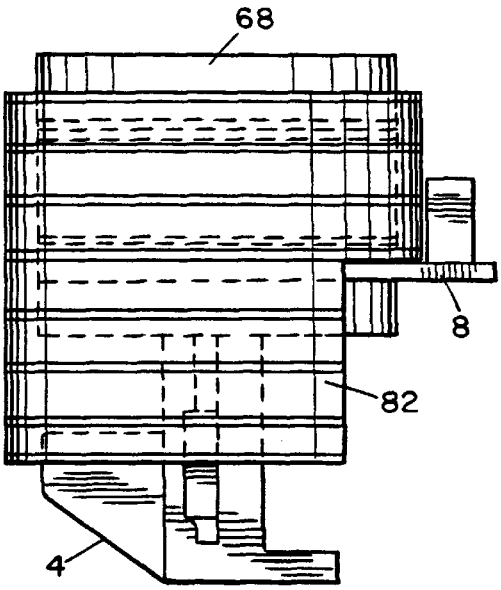
FIG. 6 is a side elevation view of the print head in a finned heatsink.
Figure 7:
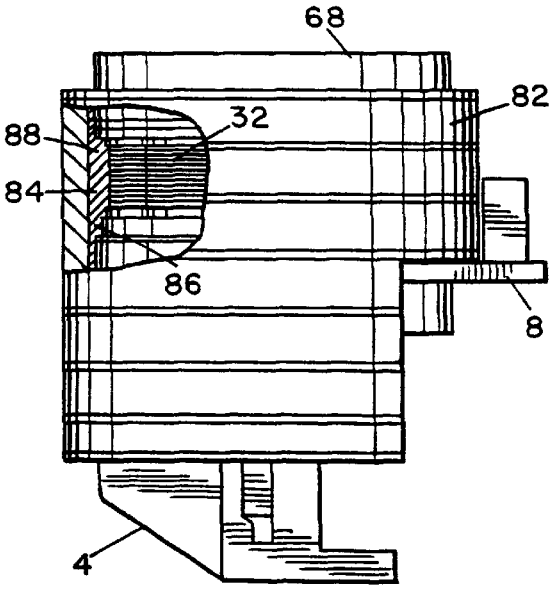
FIG. 7 is a view similar to that of FIG. 6, partially cut away to show the print head with the coil cover removed and a thermally conductive material in place.

If the print head is not to be mounted in a heat sink, coil cover 80 is included to complete the outer shell or housing of the print head 2. However, if the head is to be mounted in a heat sink 82 (FIGS. 6 and 7), the coil cover 80 is omitted and the space 88 between the bobbins 32 and the inner surface 86 of the heat sink 82 is filled with a thermally conductive material 84 (preferably a polymeric material).

A feature of this invention is the array 90 of the printing ends 12 of the print wires 14 at the output guide 10. Two alternative arrays are illustrated graphically in FIGS. 4 and 5. In each case there is an N×N grid in which each of the ends 12 of the print wires 14 is located at one of the coordinate junctions of the grid. (It will of course be understood that gridlines do not actually appear on the surface of the output guide 10, but are included in FIGS. 4 and 5 merely for conceptual description). The vertical and horizontal spans are generally similar, and preferably identical. Further, each vertical grid line has one and only one print wire. This feature allows both bidirectional and orthogonal printing. The print wire array also lessens wire pull back, decreases wear and noise of the print head in operation, and, since movement and friction are reduced, also reduces the power consumption of the head as compared to heads of the prior art.

Figure 4:
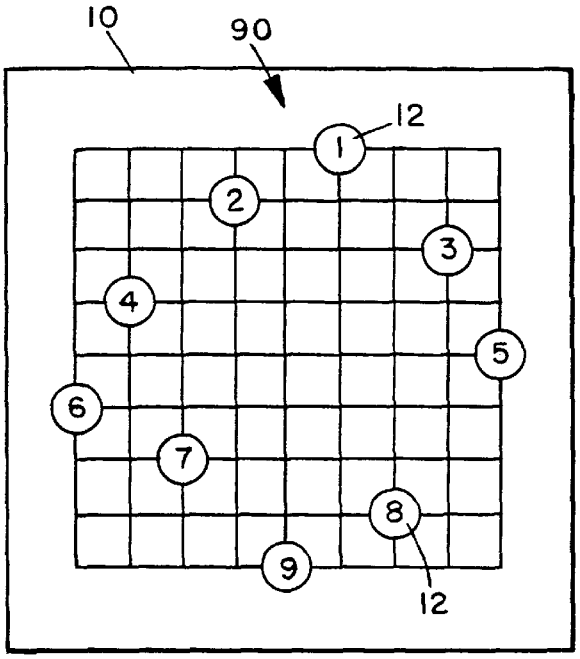
FIG. 4 is a graphical illustration of a preferred nine-print wire alignment at the printing end of the head.
Figure 5:
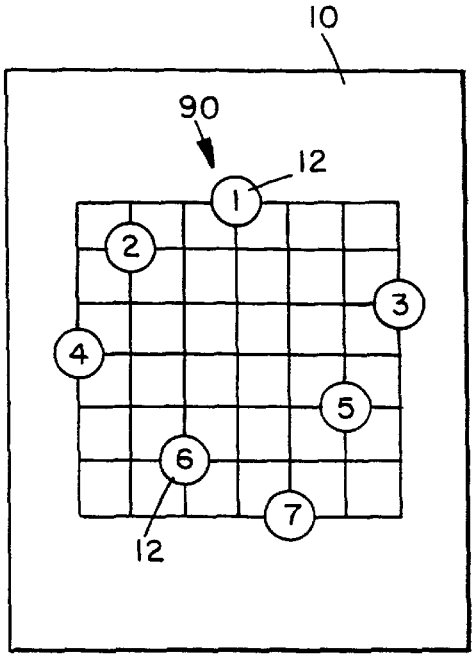
FIG. 5 is a graphical illustration of a typical seven-print wire alignment at the printing end of the head.

FIGS. 4 and 5 (especially FIG. 4) illustrate the print wire end array as being substantially diamond-shaped. It will be understood, however, that the actual shape is not important as long as the principle of not having any two print wire ends with the same horizontal and vertical grid coordinates is maintained. Thus the N×N grid pattern may be square or may have different spacing of the grid lines in either or both the horizontal and vertical directions, and even within a given direction the spacing between adjacent grid lines may vary. Thus the overall grid may be square, rectangular, rhomboid, trapezoidal, or other shape, and the print wires may be arrayed in polygonal, oval or circular patterns, as long as no two print wire ends are in vertical or horizontal alignment. Of course, the most preferred pattern is a square N×N array with the horizontal and vertical dimensions equal, as illustrated in the Figures, since that will normally optimize the average print wire travel, minimize wear and noise, and maximize the operating speed and capabilities of the print head.

The operation of the present head will be controlled by a timing device, most commonly a microcomputer or microprocessor, which times the application of current to each bobbin coil 32 and thus controls the moment at which each print wire 14 is driven to contact the inked ribbon and print-receiving medium. Since the alignment of the medium and print head is constantly changing as one moves relative to the other, driven by traversing means (not shown), the print wire ends will cross the vertical printing line at different times. However, the relative movement is at a constant linear rate and therefore the timing device can apply current to the bobbin coil 32 and activate each print wire precisely when it has moved into alignment with the printing line. Normally this will be done by fixing the time when the lead print wire 14 (for instance, print wire no. 5 or 6 in FIG. 4, depending on which way the head is moving) as the starting time for formation of each printed character, and then retarding the activation of the remaining print wires sequentially by a predetermined period of time such that each print wire (if its dot is to be part of the character being printed) is activated only as it passes the print line. This is most conveniently accomplished when the vertical elements of the N×N grid are equally spaced.

The present print head 2 can be used with a wide variety of printers and print mechanisms. The through hole 17 and recesses 21 allow a custom ribbon guide to be snapped in place to accommodate many different ribbon designs. The external contacts 92 of the circuit board 34 maybe connected to any compatible ribbon cable (not shown). Since the cable is not a part of the head structure itself, changing from one printer's cable to another printer's cable is merely a matter of disconnecting one cable and attaching the other; no changes of the head 2 itself are involved.

Even though the service life of the present print head is markedly extended compared to the service life of prior art print heads (>500,000,000 print strokes as compared to the prior art maximum of about 200,000,000 print strokes), it is anticipated that printers can last longer than the print head's service life. Therefore the connector 8 allows the print head 2 to be field replaceable at the end of its life. If two printers are plug compatible to the PCB 8 standard, there is a cost advantage in using the largest volume and the lowest cost print head.

It will be evident that there are numerous embodiments of the present invention which, while not discussed above, are clearly within the scope and spirit of the invention. The above discussion is therefore intended to be exemplary only, and the actual scope of the invention is to be defined solely by the appended claims.

I claim:

1. A dot matrix print head for printing on a print receiving medium, said print head comprising:

a plurality of elongated print wires disposed about a central axis, each print wire having a printing end and a driving end;

a wire housing comprising a guide nose for aligning said printing ends of said print wires into a predetermined alignment and guiding said print wires in alignment during a printing stroke, said alignment being such that said print head can print continuously while one of said print head and said print receiving medium is traversing in two orthogonal directions; reversible actuating means for selectively actuating said print wires for said printing stroke through said driving ends, said actuating means comprising an armature assembly, said armature assembly comprising a plurality of print wire contacting fingers equal in number to said number of print wires and a magnetically soft plunger on each said finger, each finger being cantilevered and having its fulcrum in said outer perimeter area of said armature;

a magnetic yoke adjacent to said fingers of said armature assembly and having a plurality of activatable electric coils mounted on poles thereon and a flux plate operably associated therewith, each coil in proximity to a respective plunger, the greater portion of said yoke being disposed toward said central axis and said coils and plungers being disposed outwardly therefrom, such that application of electric current to a coil creates a magnetic field in said yoke, pole and flux plate adjacent to said plunger, magnetic flux lines of which form a loop where said coil, pole, plunger and flux plate are disposed in that portion of said loop distal to said central axis, urging said plunger toward said pole and coil and causing deflection in said finger, said deflection contacting said driving end of a print wire and activating said print wire into a printing stroke;

a resilient member incorporated in said armature assembly for biasing said armature fingers away from said print wires when electrical current is not applied to said coils, comprising a circular ring having a plurality of extensions extending inwardly thereof, said extensions being equal in number and spacing to said fingers of said armature, with said fingers being adhered to said extensions and said resilient member being biased away from said yoke, whereby when electric current is halted to said coil, said resilient member urges all said fingers away from said yoke and enhances retraction of said print wires; and biasing members each cooperating with a print wire for returning said print wires to their initial positions following said printing stroke when said armature fingers are biased away from said print wires, such print wires thereupon being positioned for a subsequent printing stroke.

2. A print head as in claim 1 wherein the length of each said pole is substantially greater than the length of said respective plunger.

3. A print head as in claim 2 wherein the pole:plunger length ratio is on the order of approximately 3–4:1.

4. A print head as in claim 1 further comprising means for electrical connection of said actuating means to external timing means, said timing means comprising sequencing means responsive to the unique time of alignment of each print wire with said vertical line on said receiving medium for applying electrical current to said actuating means.

5. A print head as in claim 4 wherein said means for electrical connection comprises a printed circuit board providing separate connection of each said coil to said external timing means.

6. A print head as in claim 5 wherein tolerances within said assembled print head are not affected by the thickness of said printed circuit board.

7. A print head as in claim 4 wherein said means for electrical connection comprises a standard plug to which any compatible external timing means can be operably attached.

8. A print head as in claim 1 wherein said fingers pivot at the outer periphery of said circular ring.

9. A print head as in claim 1 wherein said plurality of coils is surrounded by a cover.

10. A print head as in claim 1 wherein said print head is enclosed in a heat sink, and space between said plurality of said coils and an inner surface of said heat sink is filled with a thermally conductive material.

11. A print head as in claim 1 wherein said alignment of said printing ends of said print wires is such that during a single printing stroke each print wire prints on said print receiving medium at a point which is not in vertical or horizontal alignment with a printing point on said medium of any other print wire.

12. A print head as in claim 11 comprising N print wires and said printing ends of said print wires are disposed in an N×N matrix wherein no printing end occupies the same vertical position in said matrix as any other printing end.

13. A print head as in claim 1 further comprising head mounting means for attaching said print head to head receiving means on a dot matrix printer.

14. A print head as in claim 13 further comprising said head mounting means is of a configuration compatible with a plurality of different head receiving means.

15. A print head as in claim 1 further comprising guide mounting means for installing a ribbon guide such that said ribbon guide is compatible with a plurality different ribbon types.

16. A method for imparting print to a print receiving medium, said method comprising:

providing a print head comprising a plurality of elongated print wires disposed about a central axis, each print wire having a printing end and a driving end;

a wire housing comprising a guide nose for aligning said printing ends of said print wires into a predetermined alignment and guiding said print wires in said alignment during a printing stroke, said alignment placing said printing ends in an array through which said print head can print continuously while one of said print head and said print receiving medium is traversing in two orthogonal directions;

reversible actuating means for selectively actuating said print wires for said printing stroke through said driving ends, said actuating means comprising an armature assembly, said armature assembly comprising a plurality of print wire contacting fingers equal in number to said number of print wires and a magnetically soft plunger on each finger, each said finger being cantilevered and having its fulcrum in said outer perimeter area of said armature;

a magnetic yoke adjacent to said fingers of said armature, said yoke being positioned such that its greater portion is disposed toward said central axis and said coils and plungers are disposed outwardly therefrom, and having a plurality of activatable electric coils mounted on poles thereon and a flux plate operably associated therewith, each coil in proximity to a respective plunger, such that application of electric current to a coil creates a magnetic field in said yoke, pole and flux plate adjacent to said plunger, induced magnetic flux lines of which form a loop where said coil, pole, plunger and flux plate are disposed in that portion of said loop distal to said central axis, urging said plunger toward said pole and coil and causing deflection in said finger, said deflection contacting said driving end of a print wire and activating said print wire into a printing stroke;

a resilient member incorporated in said armature assembly for biasing said armature fingers away from said print wires when electrical current is not applied to said coils, said resilient member being provided as a circular ring having a plurality of extensions extending inwardly thereof, said extensions being equal in number and spacing to said fingers of said armature, with said fingers being adhered to said extensions and said resilient member being biased away from said yoke, whereby when electric current is halted to said coil, said resilient member urges all said fingers away from said yoke and enhances retraction of said print wires; and biasing members each cooperating with a print wire for returning said print wires to their initial positions following said printing stroke when said armature fingers are biased away from said print wires;

applying an electric current to at least one of said coils thereby actuating said print wire associated with each actuated coil into a printing stroke and causes a visible dot to be imprinted on said print receiving medium; and thereafter halting application of said electric current such that each said coil is deactuated and said resilient means and said biasing means cause each said print wire to return to its initial position.

17. A method as in claim 16 further comprising causing a plurality of printing strokes by repeatedly providing a cycle of applied and halted electric current to said coils, each such cycle causing a single printing stroke, and between each such cycle causing said print head and said print receiving medium to traverse a predetermined distance relative to each other, such that each successive printing stroke imparts a resultant print pattern onto said print receiving medium at a location spaced apart from print pattern imparted by the preceding printing stroke by said predetermined distance.

18. A method as in claim 17 wherein an imparted print pattern is displaced laterally from at least one preceding imparted print patterns.

19. A method as in claim 17 wherein an imparted print pattern is displaced orthogonally from at least one preceding imparted print patterns.

20. A method as in claim 16 further comprising providing each said pole with a length which is substantially greater than the length of said respective plunger.

21. A method as in claim 20 further comprising providing a pole:plunger length ratio on the order of approximately 3–4:1.

22. A method as in claim 16 further comprising pivotally positioning said fingers at the outer periphery of said circular ring.

23. A method as in claim 16 further comprising removing heat generated by said print head during operation from said print head by enclosing said print head in a heat sink, providing space between said plurality of said coils and an inner surface of said heat sink, and filling said space with a thermally conductive material.

24. A method as in claim 16 comprising aligning said printing ends of said print wires such that during a single printing stroke each print wire prints on said print receiving medium at a point which is not in vertical or horizontal alignment with a printing point on said medium of any other print wire.

25. A method as in claim 24 comprising providing N print wires and disposing said printing ends of said print wires in an N×N matrix wherein no printing end occupies the same vertical position in said matrix as any other printing end.

26. A method as in claim 24 further comprising electrically connecting said actuating means to external timing means and operating said timing means in response to the unique time of alignment of each print wire with a reference point on said receiving medium to apply electrical current to said actuating means.

* * * * *